US008905284B2

(12) United States Patent
Kunz et al.

(10) Patent No.: US 8,905,284 B2
(45) Date of Patent: Dec. 9, 2014

(54) FASTENER SUPPLY ASSEMBLY

(75) Inventors: Michael Kunz, Dorndorf (DE); Stefan D. Gensmann, Fruecht (DE); Markus Rompel, Runke/Schadeck (DE)

(73) Assignee: Black & Decker Inc., Newark, DE (US)

( * ) Notice: Subject to any disclaimer, the term of this patent is extended or adjusted under 35 U.S.C. 154(b) by 1161 days.

(21) Appl. No.: 12/475,078

(22) Filed: May 29, 2009

(65) Prior Publication Data

US 2009/0294507 A1 Dec. 3, 2009

(30) Foreign Application Priority Data

May 30, 2008 (GB) ..... 0809870.9

(51) Int. Cl.
*B25C 1/16* (2006.01)
*B25C 5/16* (2006.01)

(52) U.S. Cl.
CPC ..... *B25C 5/1679* (2013.01)
USPC ..... 227/120; 227/109

(58) Field of Classification Search
USPC ..... 227/78, 109, 120, 121, 138, 139
See application file for complete search history.

(56) References Cited

U.S. PATENT DOCUMENTS 4,139,136 A * 2/1979 Catalano ..... 227/109
5,096,109 A * 3/1992 Chen ..... 227/109
5,465,868 A * 11/1995 Bonomi ..... 221/165
5,497,931 A * 3/1996 Nakamura ..... 227/109
5,575,415 A * 11/1996 Sucher ..... 227/109
6,076,720 A * 6/2000 Deng ..... 227/109
2003/0010803 A1 * 1/2003 Schuster ..... 227/109
2004/0056065 A1 3/2004 Wasko
2008/0257931 A1 * 10/2008 Lin et al. ..... 227/76

FOREIGN PATENT DOCUMENTS

DE 1478897 A1 5/1969
EP 1658942 B1 5/2007

OTHER PUBLICATIONS

Matzdorf, Udo—European Search Report—Oct. 13, 2009—The Hague.

* cited by examiner

*Primary Examiner* — Andrew M Tecco
*Assistant Examiner* — Nathaniel Chukwurah
(74) *Attorney, Agent, or Firm* — Rhonda L. Barton

(57) ABSTRACT

A fastener supply assembly for a fastener driving tool includes an outlet passage arranged to expel fasteners from the assembly to a workpiece during use, a magazine comprising a plurality of supply channels arranged to hold fasteners and supply them to the outlet passage, and a channel selector. The channel select has an opening and is arranged to selectively connect, via its opening, the outlet passage with each respective supply channel of the magazine, by movement of the channel selector relative to both the magazine and a longitudinal axis of the outlet passage. The movement of the channel selector may comprise rotation about the longitudinal axis of the outlet passage.

19 Claims, 18 Drawing Sheets

FASTENER SUPPLY ASSEMBLY

BACKGROUND OF THE INVENTION

1. Field of the Invention

The present invention relates to fastener supply assemblies for fastener driving tools, and especially to fastener magazines for such tools. The invention particularly concerns such tools, assemblies and magazines in which the fasteners comprise nails. Thus, the tool according to the invention may comprise a nailer, the assembly may comprise a nail supply assembly, and the magazine my comprise a nail magazine. However, the invention also concerns other types of fasteners, including pins, staples, screws, rivets, etc.

2. Description of the Related Art

Many fastener driving tools include a driver that is propelled rapidly against a fastener to drive a fastener from the tool into a workpiece. The driver may comprise a piston, or a ram (impact member), for example. The driver may be propelled in any of a variety of ways, including (but not limited to) pneumatically, by combustion, by means of a strap or chain, by means of a separate piston, or by means of one or more flywheels, for example.

Fastener driving (firing) tools have for many years included magazines (i.e. holding and supply devices) for the fasteners that are fired (driven) from the tools. There are various known types of such magazines, including magazines arranged to store and supply loose fasteners, magazines for coiled strips of fasteners, and magazines for straight strips of fasteners. Each of the different known types of fastener magazine is an attempt to find the best compromise between various different criteria. Such criteria include: maximized fastener storage capacity; efficiency and reliability of supply of fasteners for firing; efficiency and ease of insertion of fasteners into the magazine; compactness and optimization of shape and configuration; and lightness of weight.

U.S. Pat. No. 3,266,697 discloses a fastener driving apparatus having a magazine comprising first and second fastener guideways arranged side-by-side, for holding and supplying fasteners and feeding them into a forwardly situated drive track of the apparatus, so that the fasteners can be driven from the apparatus. Toward its rear (spaced from the drive track), the magazine is pivotably mounted to a rear portion of the apparatus, so that a forward end face of the magazine can move laterally with respect to a feed slot that communicates with the drive track. In this way, first one and then the other of the guideways of the magazine may be brought into alignment with the feed slot of the drive track. A latching mechanism maintains the magazine in a first position with a right hand guideway in alignment with the feed slot, until the right hand guideway is exhausted of fasteners, whereupon a pusher (which pushes the fasteners forward toward the drive track) moves the latch, causing the magazine to rotate with respect to the drive track, thereby moving the left hand guideway into alignment with the drive track.

BRIEF SUMMARY OF THE INVENTION

The present invention seeks to provide an improved fastener supply assembly for a fastener driving tool, and a tool including such a fastener supply assembly.

In a first aspect, the present invention provides a fastener supply assembly for a fastener driving tool, comprising an outlet passage arranged to expel fasteners from the assembly to a workpiece during use, a magazine comprising a plurality of supply channels arranged to hold fasteners and supply them to the outlet passage, and a channel selector having an opening, the channel selector arranged to selectively connect, via its opening, the outlet passage with each respective supply channel of the magazine, by movement of the channel selector relative to both the magazine and a longitudinal axis of the outlet passage.

The channel selector preferably comprises a channel selector body. In preferred embodiments of the invention, the movement of the channel selector comprises rotation, preferably rotation only. The movement of the channel selector preferably comprises rotation about the longitudinal axis of the outlet passage. However, in alternative embodiments of the invention, the movement of the channel selector may, for example, comprise translational movement. In other embodiments, the movement may comprise a combination of rotational and translational movement.

A second aspect of the invention provides a fastener driving tool comprising a fastener supply assembly according to the first aspect of the invention.

The fastener driving tool may drive or fire fasteners from the tool in any convenient manner. For example, the tool may include one or more (e.g. one or two) flywheels or other inertial members arranged to impart kinetic energy to a driver or other member, to drive or fire fasteners from the tool. Alternatively, the tool may drive or fire fasteners by means of compressed gas and/or combustion, for example. The tool may be electrically or pneumatically powered, or powered in any other convenient manner. Preferably, however, the tool is electrically powered, by mains electricity and/or by of one or more batteries or other portable electrical powering devices.

In preferred embodiments of the invention, the magazine comprises exactly two Supply channels. However, in other embodiments of the invention, the magazine may comprise three, four, five or more supply channels. Preferably, the supply channels are arranged substantially parallel to each other, but other arrangements are contemplated. The supply channels preferably are separate from each other.

It is preferred that, at least in use, the magazine is located in a fixed position with respect to the outlet passage. Advantageously, the magazine may comprise a frame (comprising one or more parts) defining the supply channels, for example with the supply channels being provided on opposite sides of a wall of the frame (i.e. separated from each other by the wall). The magazine preferably comprises an elongate frame, and the wall preferably is a substantially central elongate wall thereof. Each supply channel may be at least partially open on a side thereof opposite to the wall. The elongate frame preferably is substantially straight along at least part of its length. Additionally or alternatively, the frame may be curved along at least part of its length. The supply channels preferably are substantially straight along at least part of their length, but the supply channels may be curved along at least part of their length, for example converging toward each other, especially where they approach the channel selector, for example. The elongate frame and or the supply channels, or at least a substantially straight portion thereof, may be oriented substantially perpendicular to the outlet passage, or may be inclined at a non-perpendicular angle thereto, preferably such that the magazine is inclined backwards away from the fastener expulsion outlet of the outlet passage (or the nose part).

The magazine preferably includes at least one urging assembly arranged to urge fasteners toward the outlet passage, in use. Advantageously, each supply channel of the magazine my include a respective urging assembly. The (or each) urging assembly preferably includes a roll spring. The urging assembly may generally have a form, including a pusher part which may be resiliently rotatable into, and out of, engagement with the fasteners to be urged toward the outlet passage. Preferably, the (or each) pusher part, which pushes the fasteners, is itself pulled toward the outlet passage, for example by means of a roll spring. Alternatively, however, the pusher part(s) may be arranged to be pushed toward the outlet passage.

In preferred embodiments of the invention, fasteners held in the supply channels of the magazine are arranged to be supplied to the outlet passage by passing through the opening in the channel selector. Preferably, the channel selector provides at least part of the outlet passage. For example, the channel selector may comprise the opening, at least part of the outlet passage, and a delivery channel situated between the outlet passage and the opening, by which the opening communicates with the outlet passage. The part of the outlet passage that may be provided by the channel selector may comprise part of the length and/or part of the circumference of the outlet passage. Thus, the channel selector may provide at least part of the outlet passage in combination with a housing part, and/or a nose part, and/or an access cover part, which may be pivotable or removable, to gain access to the outlet passage, for example.

The fastener supply assembly preferably includes a housing part (e.g. as mentioned above), in which the channel selector is at least partially housed. The channel selector may, for example, be rotatably arranged in the housing part. Preferably, the channel selector includes at least one protrusion projecting outside the housing part, by which the channel selector can be manipulated. In preferred embodiments of the invention, the channel selector includes two such protrusions, preferably located on opposite sides of the outlet passage.

In preferred embodiments of the invention, the fastener supply assembly includes a nose part (e.g. as mentioned above) that provides at least part of the outlet passage. The nose part preferably is located at least partly forward of the channel selector in the direction of expulsion of fasteners from the assembly. At least a portion of the nose part may be resiliently retractable with respect to the channel selector, to prevent the fastener driving tool from firing a fastener unless the nose part is pressed against a workpiece with the nose part retracted. The nose part may additionally or alternatively comprise a fixed tubular part, to provide at least part of the length of the outlet passage, preferably arranged forwardly of the channel selector. Preferably, a retractable portion of the nose part is retractable with respect to such a fixed tubular part, and preferably the tubular part is at least partially contained in the housing part.

BRIEF DESCRIPTION OF THE DRAWINGS

Preferred embodiments of the invention will now be described, by way of example, with reference to the accompanying drawings, of which.

DETAILED DESCRIPTION OF THE INVENTION

Figure 1:
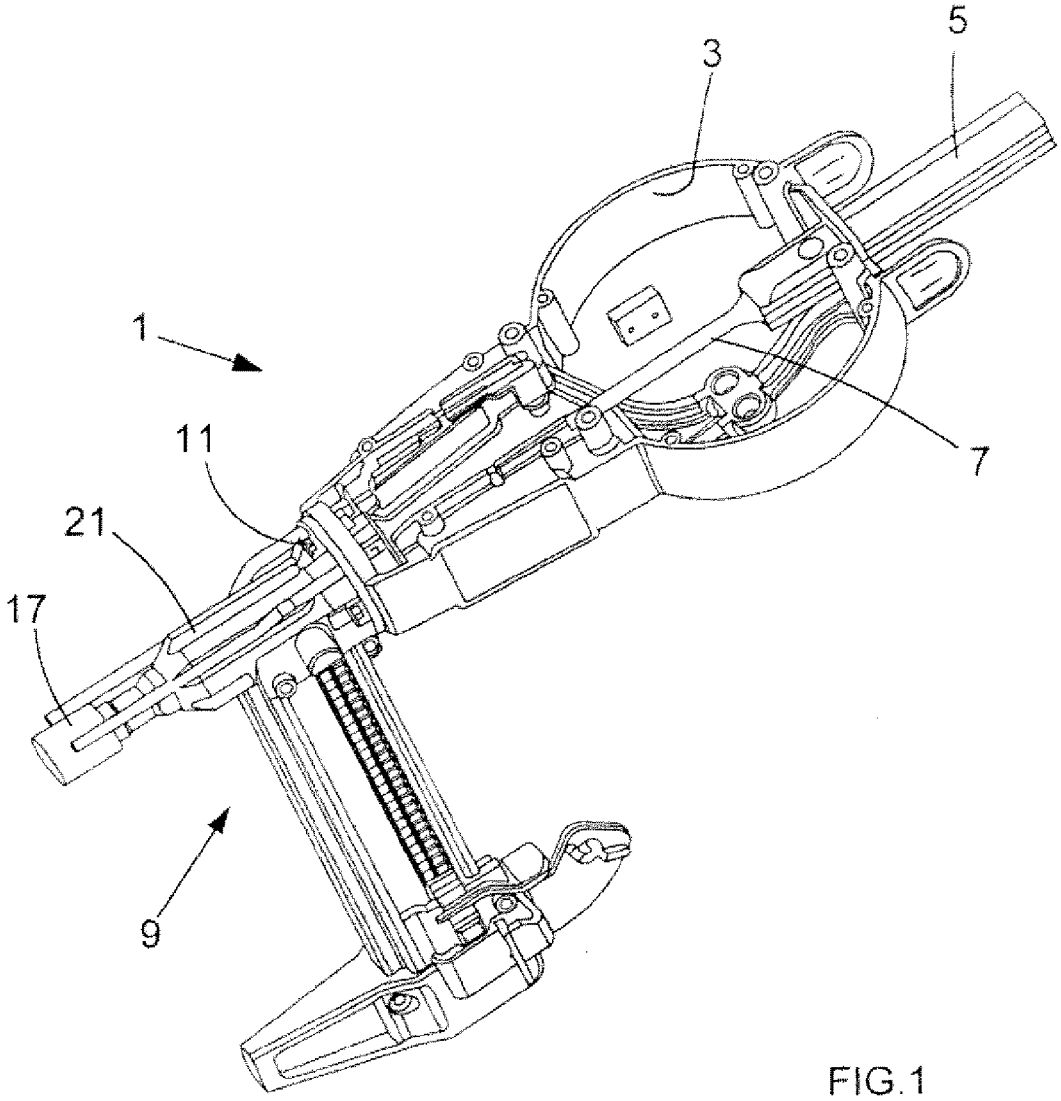
FIGS. 1 to 3 are views of part of a fastener diving tool according to the invention.
Figure 2:
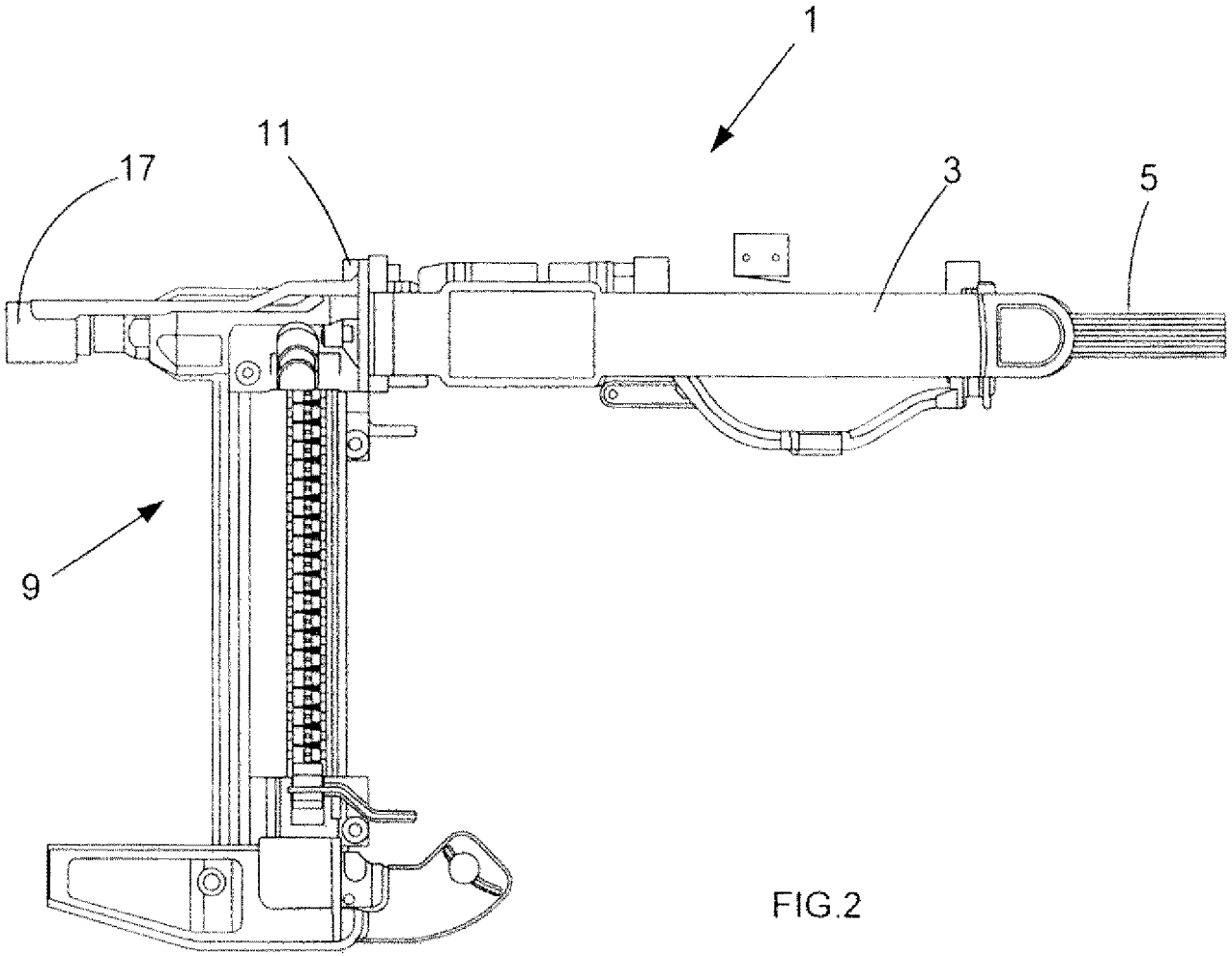
Figure 3:
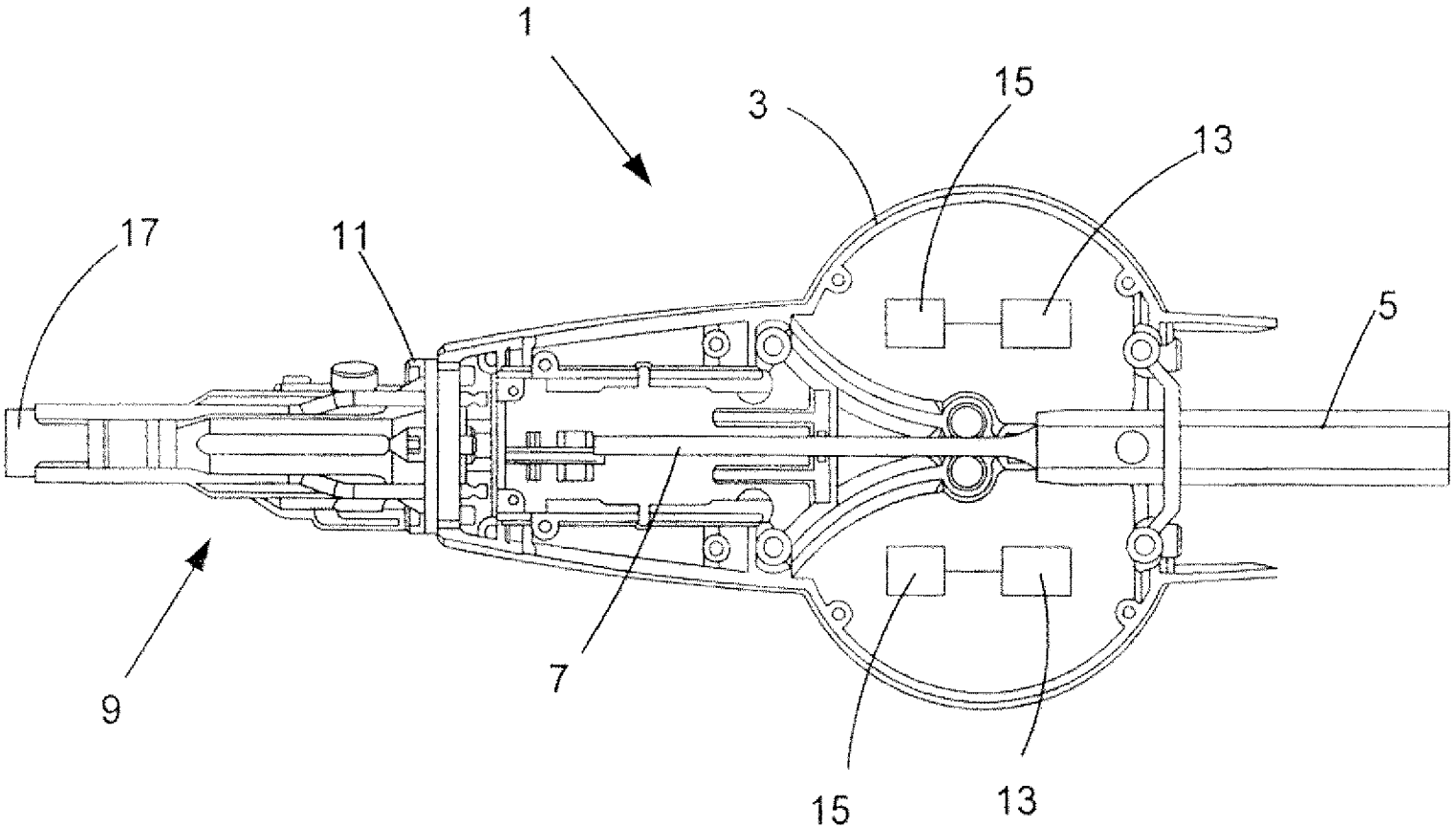

FIGS. 1 to 3 show a fastener driving tool 1 according to the invention, comprising a main body 3, a driver 5, a ram 7 attached to a front part of the driver 5, and a fastener supply assembly 9 according to the invention, attached to a front part of the main body 3, for example by means of screws 11. As shown schematically in FIG. 3, the fastener driving tool 1 includes two electric motors 13 and two flywheels 15, each flywheel being powered by a respective motor 13. Not shown, but provided in a conventional manner, the fastener driving tool 1 includes a handle, a trigger for firing the tool, and a rechargeable and removable battery for powering the motors 13. The fastener supply assembly 9 includes a resiliently retractable nose part 17.

The fastener driving tool 1 is arranged such that when a user wishes to drive or fire a fastener (e.g. a nail) into a workpiece (not shown), he pushes the nose part 17 of the tool against the workpiece, causing the nose part to retract. This allows the tool to drive a fastener into the workpiece, once the trigger is pulled. The trigger may be pulled before or after the nose part 17 is retracted (but if pulled before the nose part is retracted, the trigger must remain pulled while the nose part is retracted) to cause the fastener to be fired into the workpiece. When the trigger is in a pulled condition and the nose part is in a retracted condition, the electric motors 13 cause the flywheels 15 to propel the driver 5 forward, thereby causing the ram 7, which is attached to the front of the driver 5, to expel a fastener from the tool and fire it into the workpiece.

FIGS. 4 to 17 show a fastener supply assembly 9 according to the invention, and components thereof. As explained above, the fastener supply assembly 9 is attached to the front of the main body 3 of the fastening driving tool by means of screws 11. The fastener supply assembly 9 comprises a magazine 19, a housing part 21, a nose part 17, and a channel selector 23 (only a protrusion 25 of which is visible in FIGS. 4 to 7). An outlet passage 26 from which fasteners are fired from the tool, extends through the nose part 17 and channel selector 23, and has a longitudinal axis A-A. Both the nose part 17 and the channel selector 23 are partially housed in the housing part 21. The channel selector 23 is rotationally arranged in the housing part 21, so that it can rotate about the longitudinal axis A-A of the outlet passage.

The fastener driving tool 1 shown in the figures is a nail driving tool (i.e. a "nailer"), arranged to fire fasteners in the form of nails 27. Each nail 27 has a sleeve 29 (e.g. formed from a polymer material) located on at least part of its length. The nails 27 are arranged in strips 31, with the nails being indirectly connected to each other by means of the sleeves 29. The strips 31 of nails 27 are arranged in straight lines, with each sleeve 29 frangibly (breakably) connected to two immediately adjacent sleeves (other than the two end sleeves of the strip, each of which is connected to only one sleeve). When an end nail 27 of the strip is fired from the tool 1, the sleeve 29 located on the nail is forcibly disconnected from its adjacent sleeve by the force of the ram 7 driving the nail 27 forward with respect to the other nails in the strip, and the nail 27 together with its sleeve 29 is fired from the tool.

The magazine 19, which preferably is formed from metal and/or polymer material(s), comprises an elongate frame 33 that has two separate supply channels 35 for holding two separate strips of nails 31, one strip in each supply channel. Each strip of nails in a particular supply channel 35 may comprise a plurality of sections of nail strip, the nails in each section being joined together by means of their sleeves, and there being breaks between sections. The supply channels 35 are provided on opposite sides (left and right) of the frame 33 of the magazine, divided by a central wall 37 of the frame, and each supply channel is partially open at 36 on a side opposite the central wall 37, so that the nails 27 can be observed and partially accessed. The frame 33 of the magazine 19 is attached to the housing part 21 by partial insertion therein, and is secured thereto by means of screws 38. At the opposite end of the elongate frame 33, a foot 47 of the magazine is attached to the frame by means of a screw 48, with an end part of the frame received in the foot. The end of each supply channel 35 at the foot end of the magazine is open, by means of corresponding apertures in the foot 47, to allow nail strips 31 to be inserted into the supply channels through the foot 47. In one arrangement, a forwardly arranged end 49 of the foot is substantially level with a forward end of the nose part 17 when the nose part is retracted, to help support the tool against a workpiece when a fastener is being fired from the tool.

Each strip of nails 31 is urged in its respective supply channel 35 toward the channel selector 23 by means of a respective urging assembly 39 comprising a fastener feed device 41 including a spring-biased pusher part 43, and a roll spring 45. Each roll spring 45 continuously urges its associated feed device 41 toward the channel selector 23, because one end of the roll spring is attached to the fastener feed device 41 and the opposite end of the roll spring is attached to the housing part 21 by means of screws 46. The roll spring 45 is in a substantially unwound state when the feed device 41 is furthest from the channel selector 23, and urges the feed device 41 toward the channel selector by its tendency to achieve a fully wound state. As the feed device 41 moves closer to the channel selector 23, the roll spring 45 gradually becomes more wound. The spring-biased pusher part 43 is biased to extend into its respective supply channel 35, but may be "toggled" (rotated) against a spring bias so that it is substantially clear of the channel. In this way, normally during use the pusher part 43 presses by virtue of the roll spring 45 against the rear nail 27 of the nail strip 31, to urge the nail strip toward the channel selector 23, but the pusher part 43 may be rotated out of the way to allow a new nail strip 31 to be inserted into the supply channel 35 through an aperture in the foot 47 of the magazine 19.

The nail magazine is thus arranged to hold and feed the strips 31 of nails 27, such that once a nail 27 has been fired from the tool, the entire strip 31 of nails 27 moves toward the outlet passage so that the nail constituting the new end of the strip takes the place of the nail that has been fired. The polymer (plastic) sleeves 29 are arranged so that they are normally retained on the nail when it is fired into the workpiece (e.g. wood, metal or concrete), but with a front part of the sleeve 29 breaking and splaying between the workpiece and the nail 27.

The magazine 19 comprises an elongate frame 33 that has two separate supply channels 35 for holding two separate strips of nails 31. The supply channels 35 are provided on opposite sides (left and right) of the frame 33 of the magazine, divided by a central wall 37 of the frame. One strip 31 of nails 27 at a time extends into the outlet passage part of the channel selector 23 via its opening 24 and its delivery channel 22. That is, when the tool is operational, the channel selector 23 connects one supply channel 35 of the magazine at a time with the outlet passage 26 through the opening 24 and delivery channel 22 in the channel selector. As mentioned above, the outlet passage 26 extends through both the nose part 17 and the channel selector 23. In the preferred embodiment of the invention that is illustrated, the channel selector 23 holds three nails 27 at a time, one of which is in the outlet passage 26 of the tool (i.e. in that part of the outlet passage provided by the channel selector), ready to be fired, and the others being in the delivery channel 22 and/or the opening 24. In other embodiments, the channel selector can hold more, or fewer, nails or other fasteners at a time, for example one, two, or four fasteners.

Once one strip 31 of nails 27 or other fasteners has been almost fully used up, e.g. so that only three nails remain in the strip (i.e. there are no nails remaining in the supply channel 35 from which the nails have been fed), the user can rotate the channel selector 23 in the housing part 21 about the longitudinal axis A-A of the outlet passage so that it is aligned with the other supply channel 35, i.e. aligned with another strip of nails or other fasteners located in the other supply channel 35. In this way, the magazine 19 can hold approximately twice as many nails or other fasteners as would be the case if it included only one supply channel 35.

Figure 4:
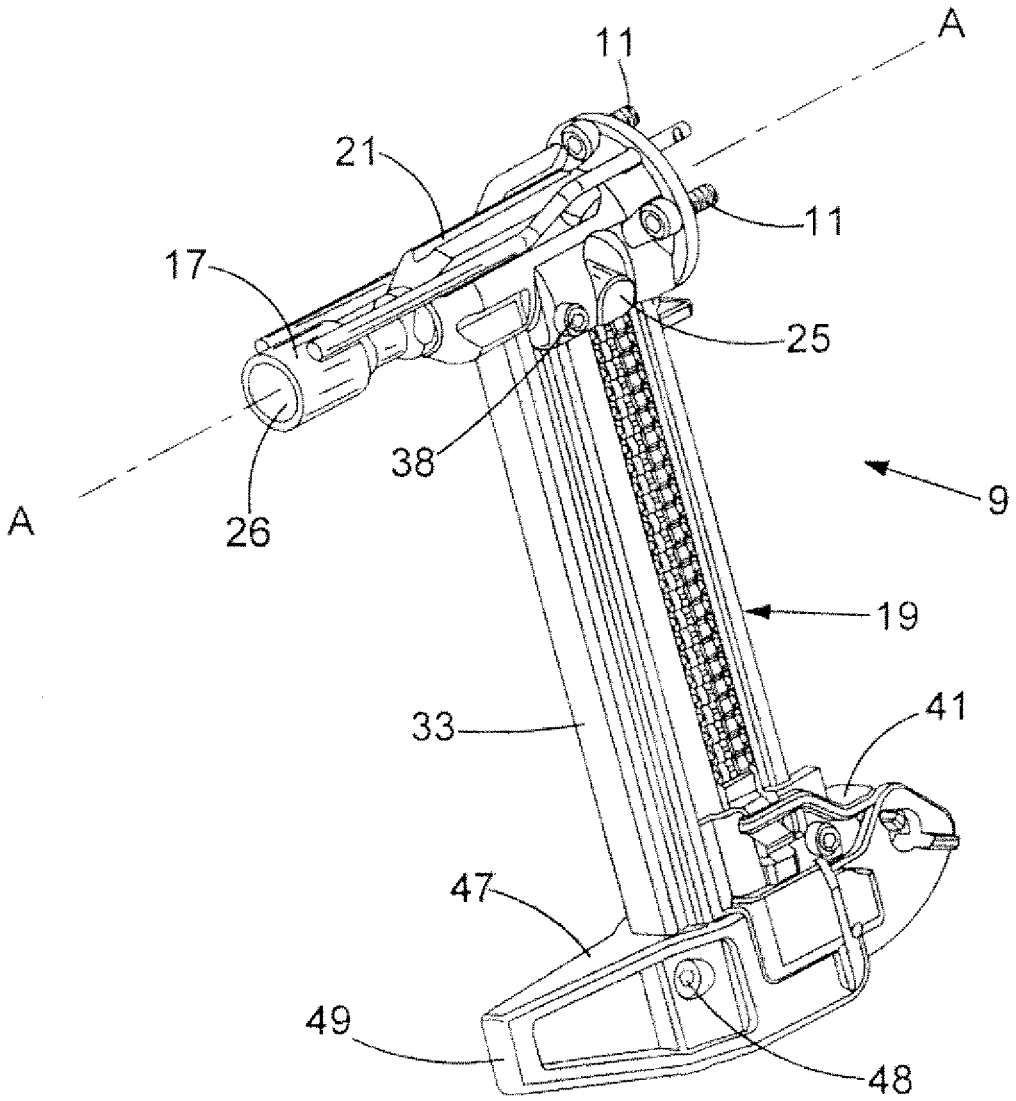
FIGS. 4 to 9 are views of a fastener supply assembly according to the invention, and components thereof.
Figure 5:
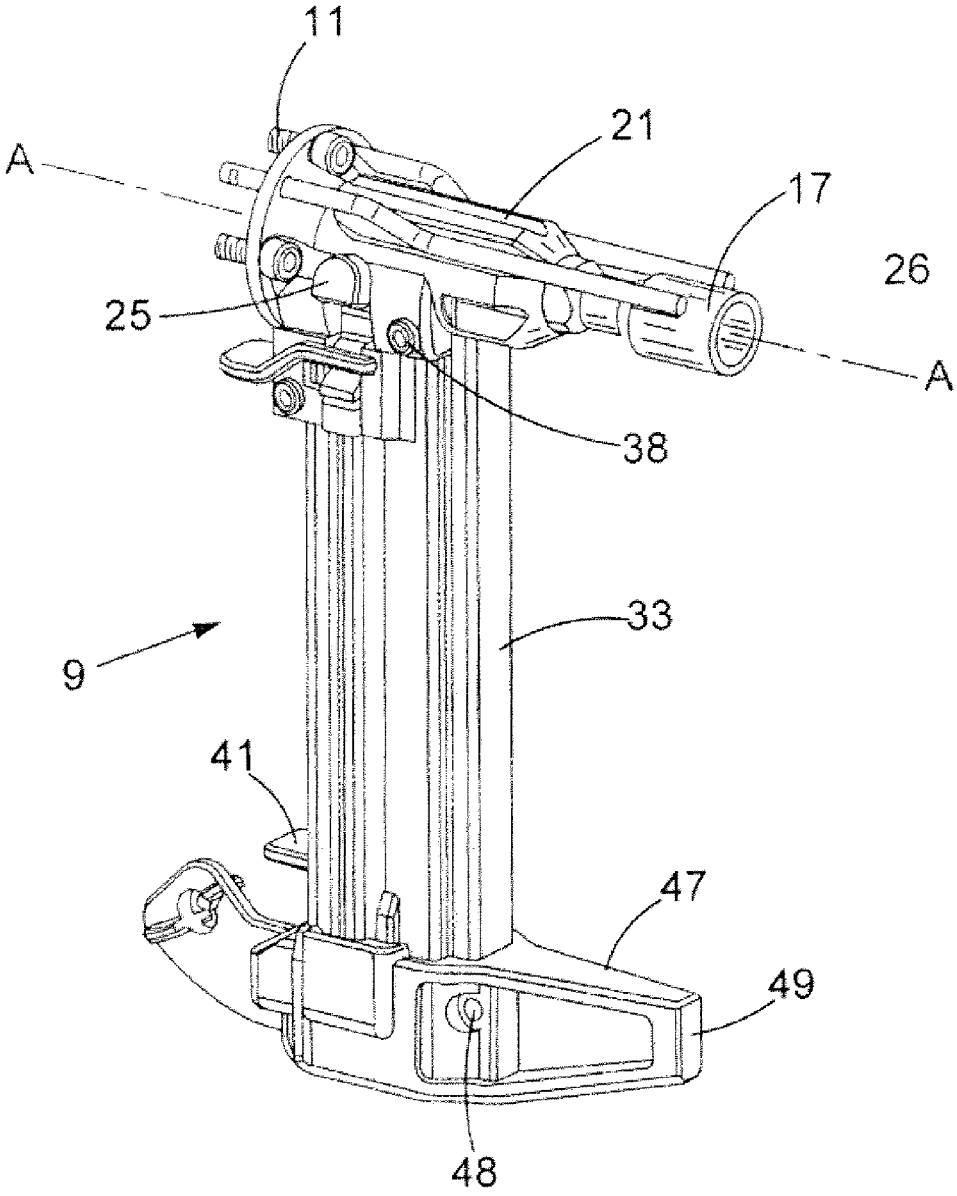
Figure 6:
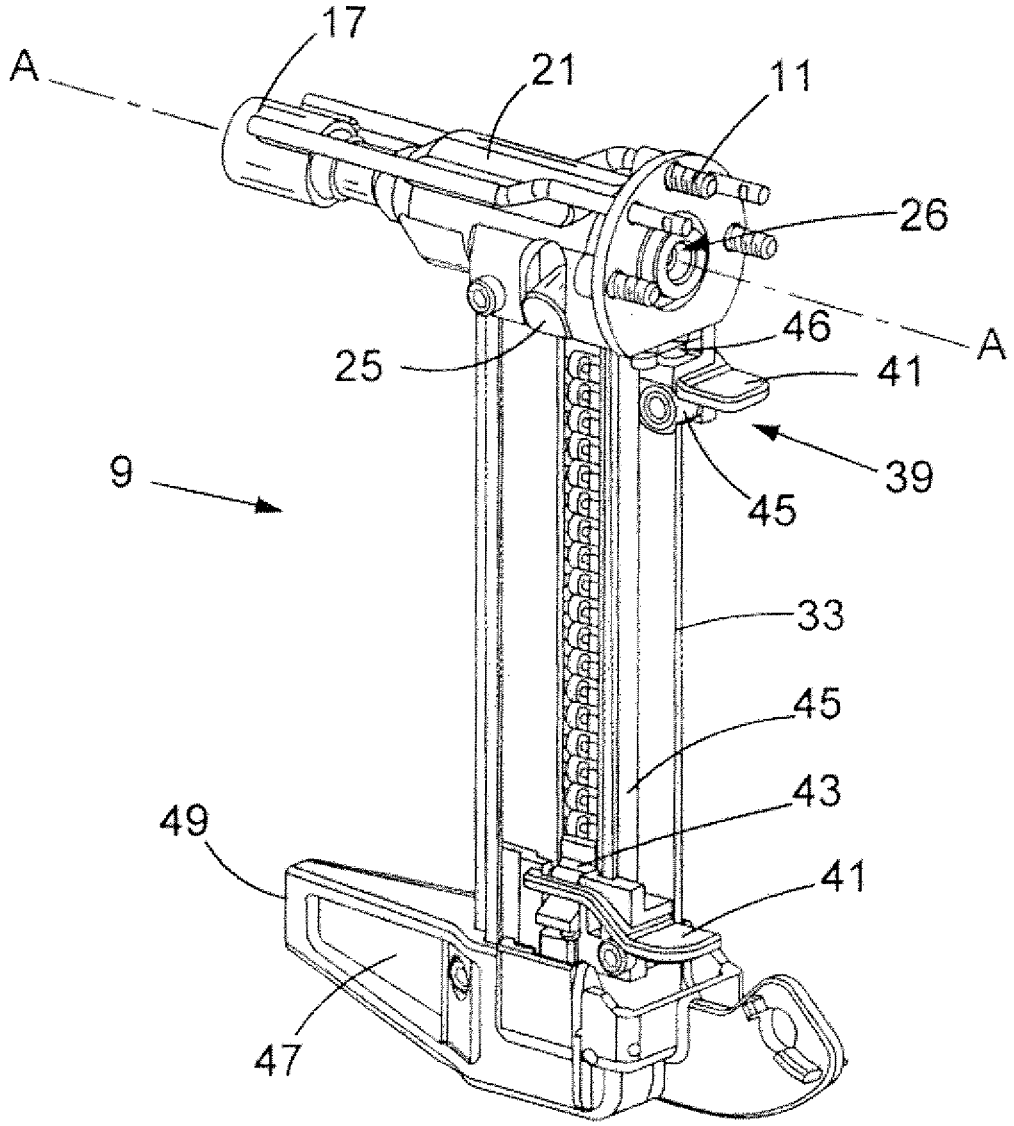
Figure 7:
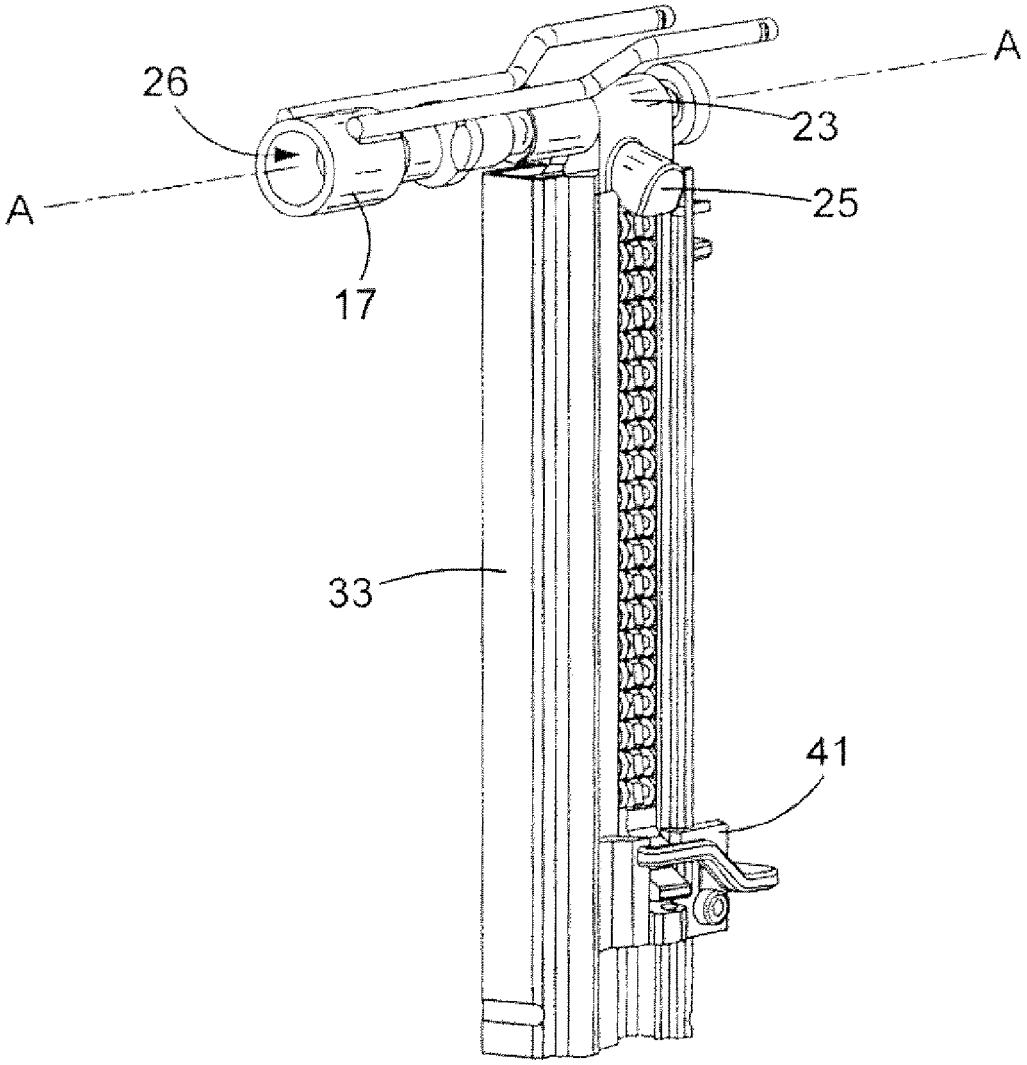
Figure 8:
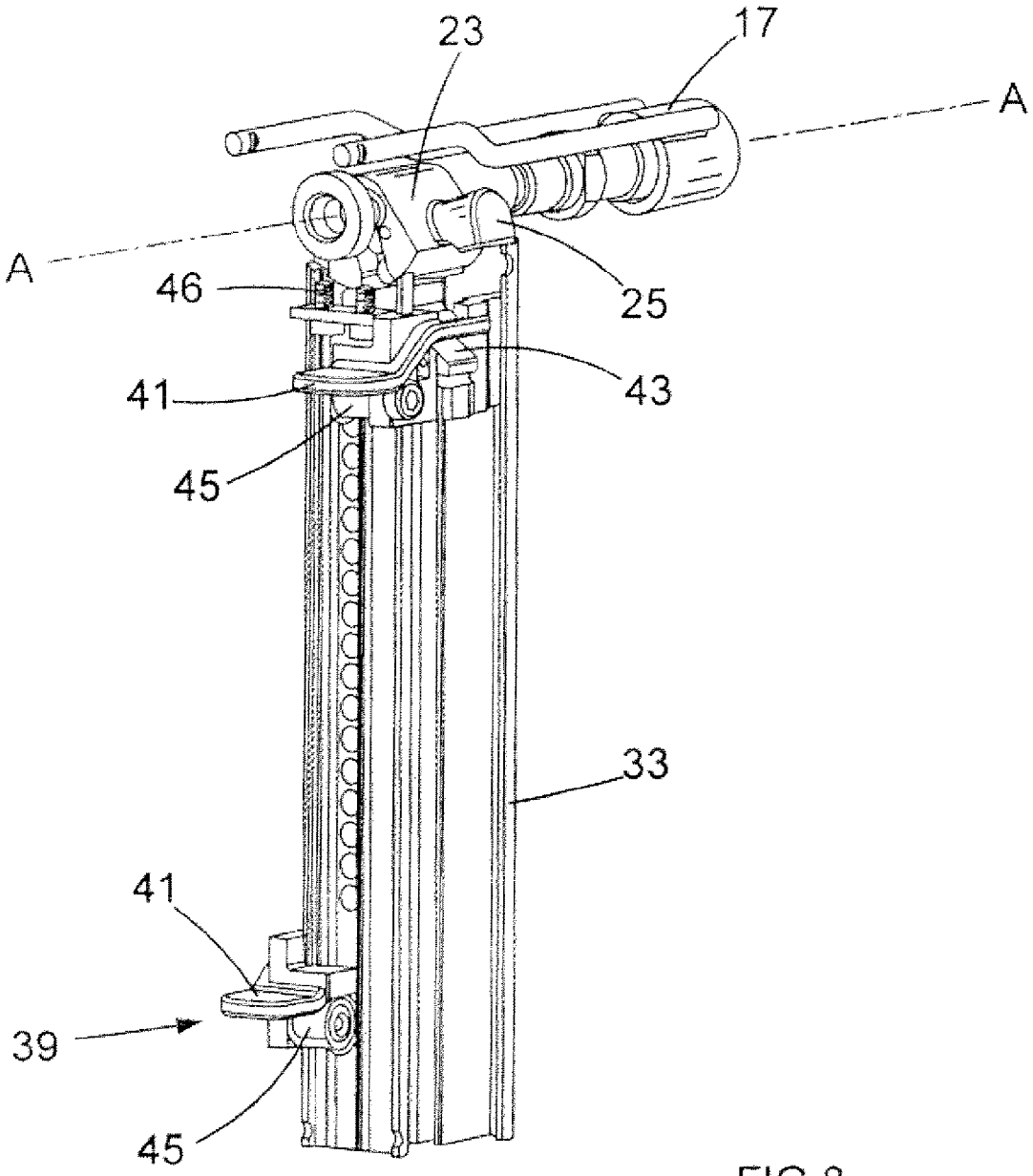
Figure 9:
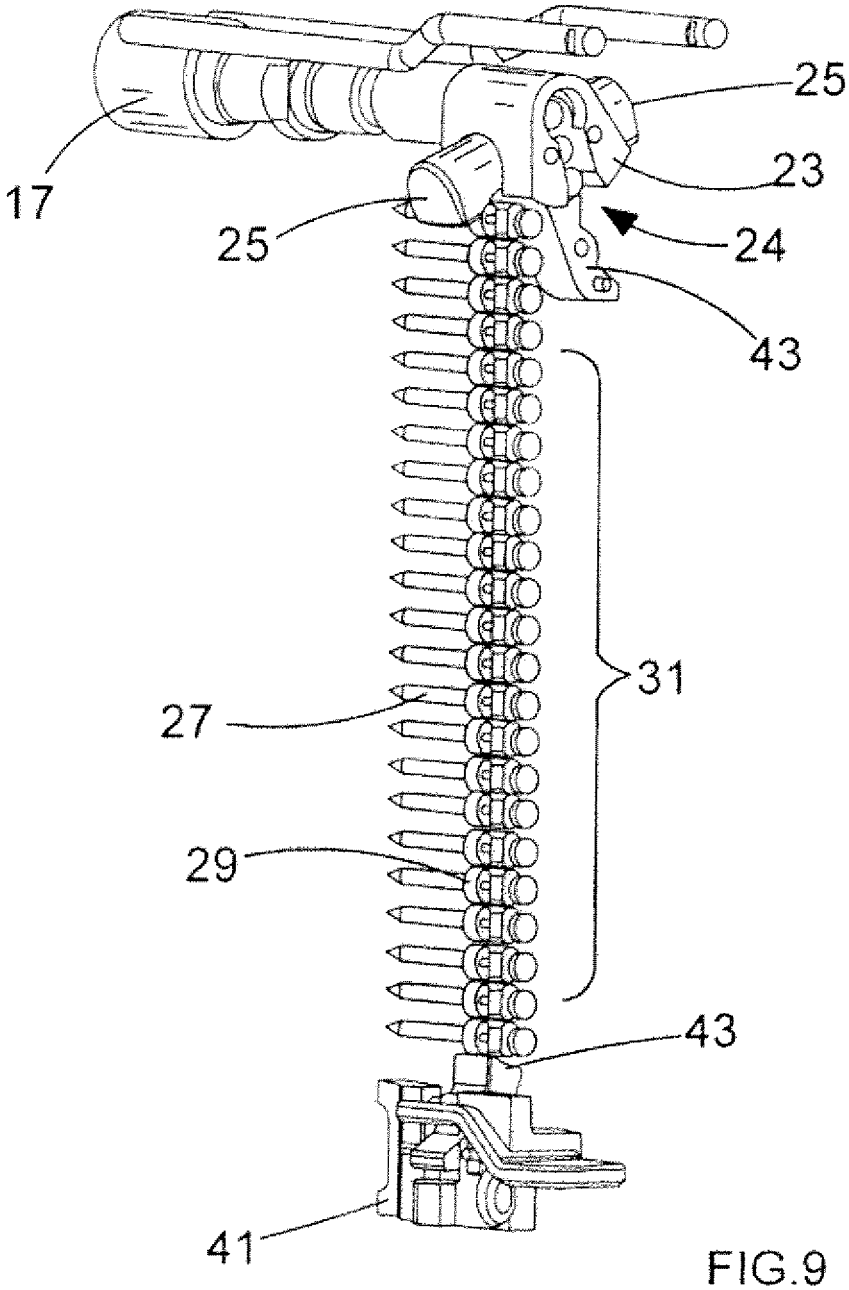
Figure 10:
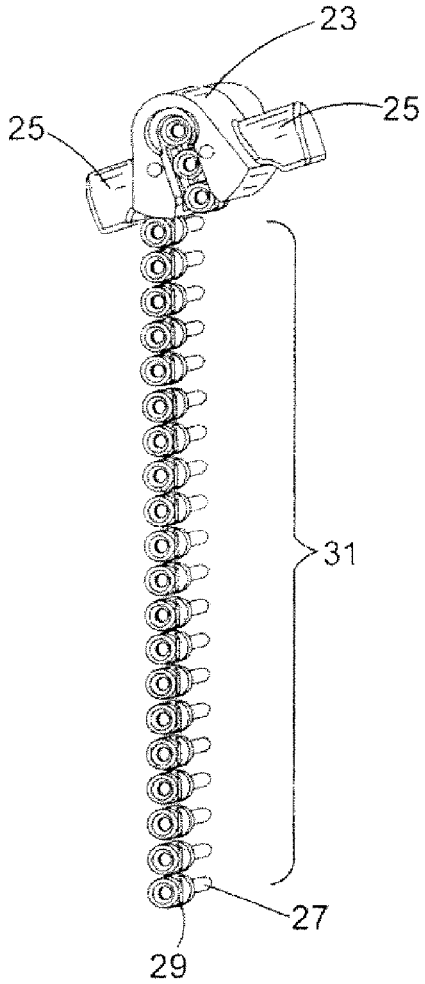
FIGS. 10 to 14 are views of a channel selector of a fastener supply assembly according to the invention.
Figure 11:
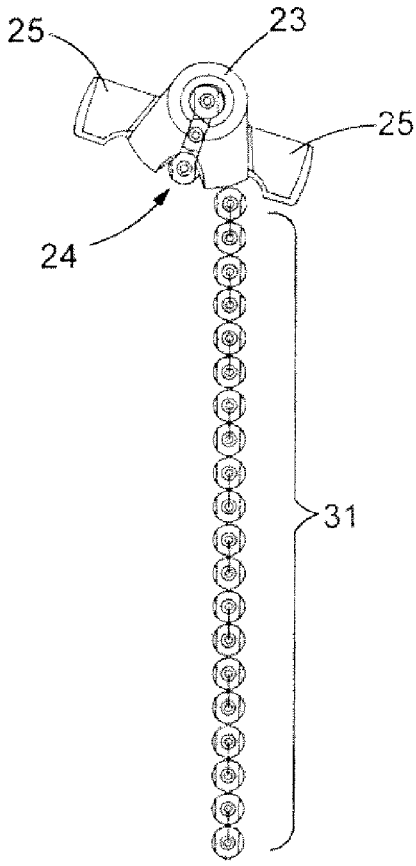
Figure 12:
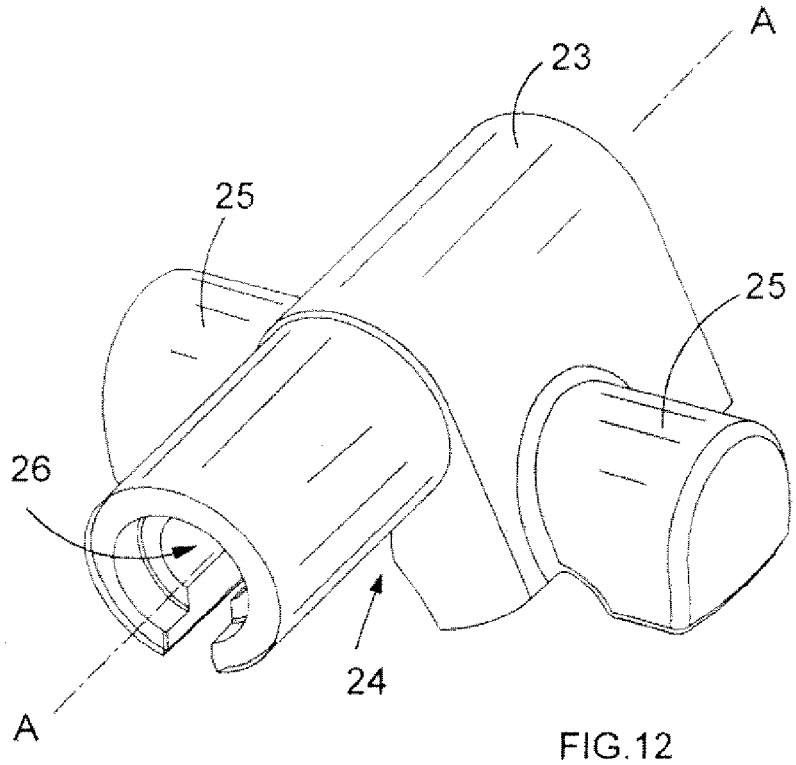
Figure 13:
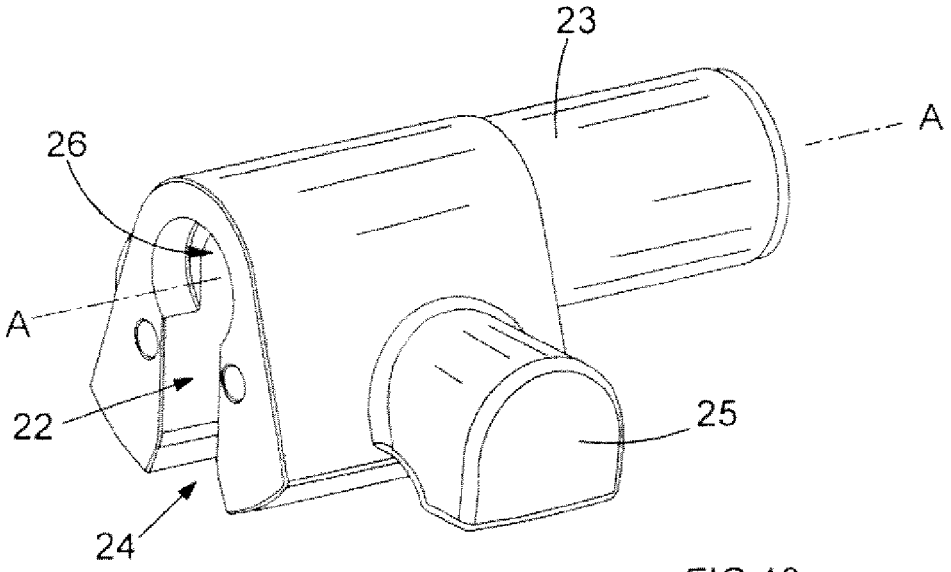
Figure 14:
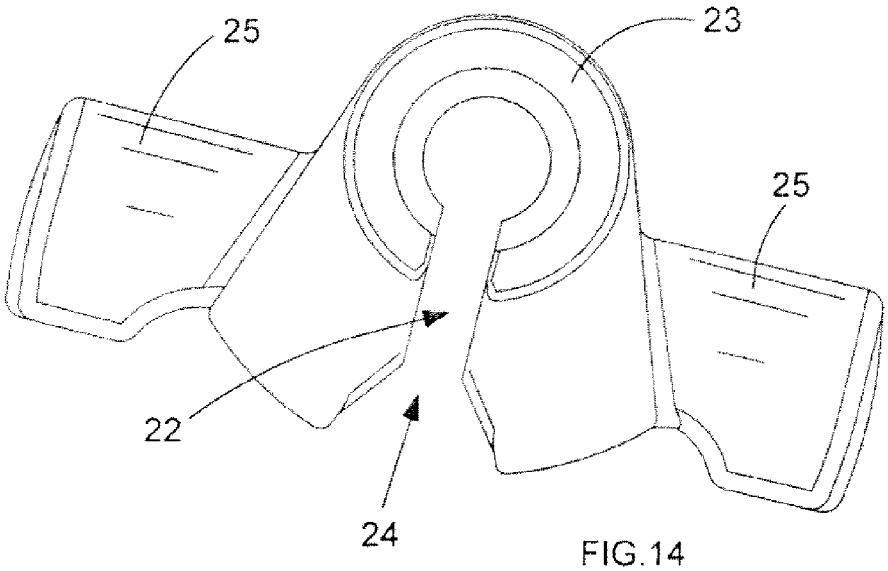
Figure 15:
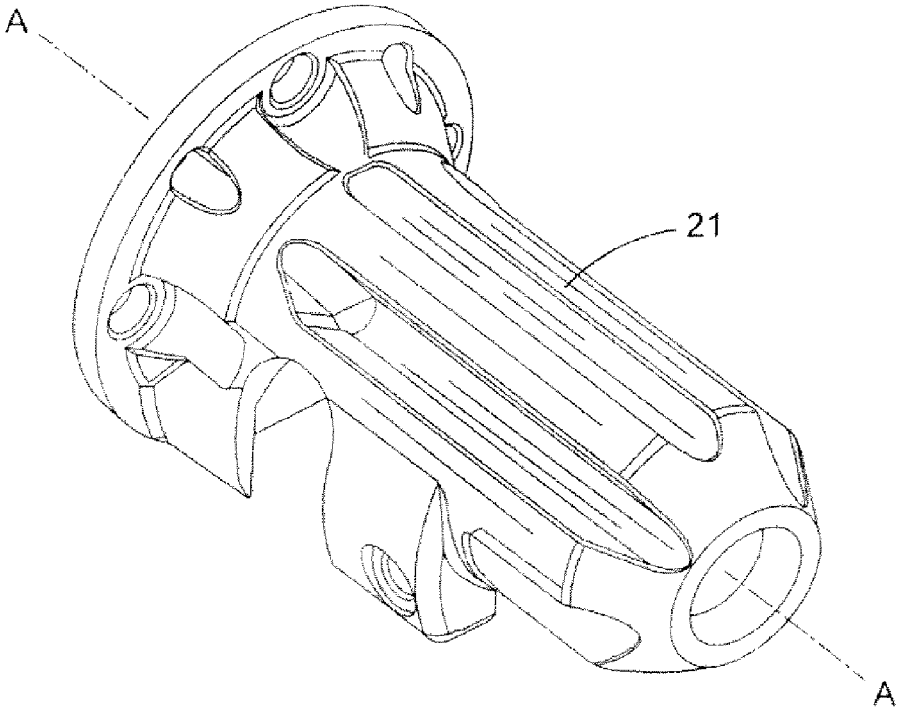
FIGS. 15 and 16 are views of a housing part of a fastener supply assembly according to the invention.
Figure 16:
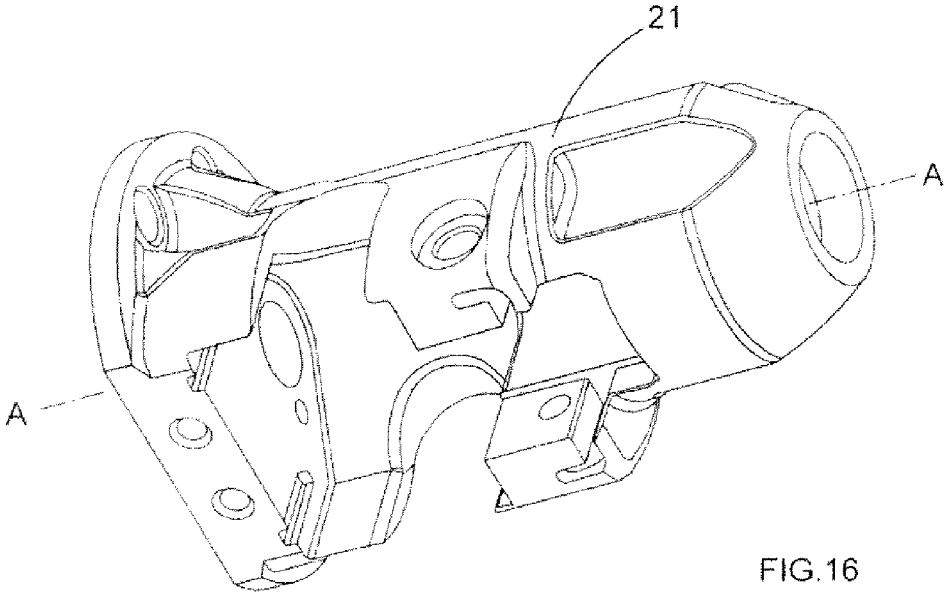
Figure 17:
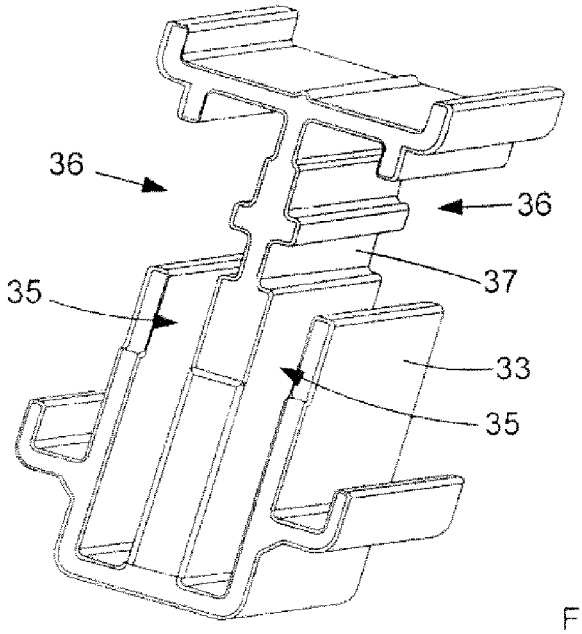
FIG. 17 is a view of a magazine frame of a fastener supply assembly according to the invention.
Figure 18:
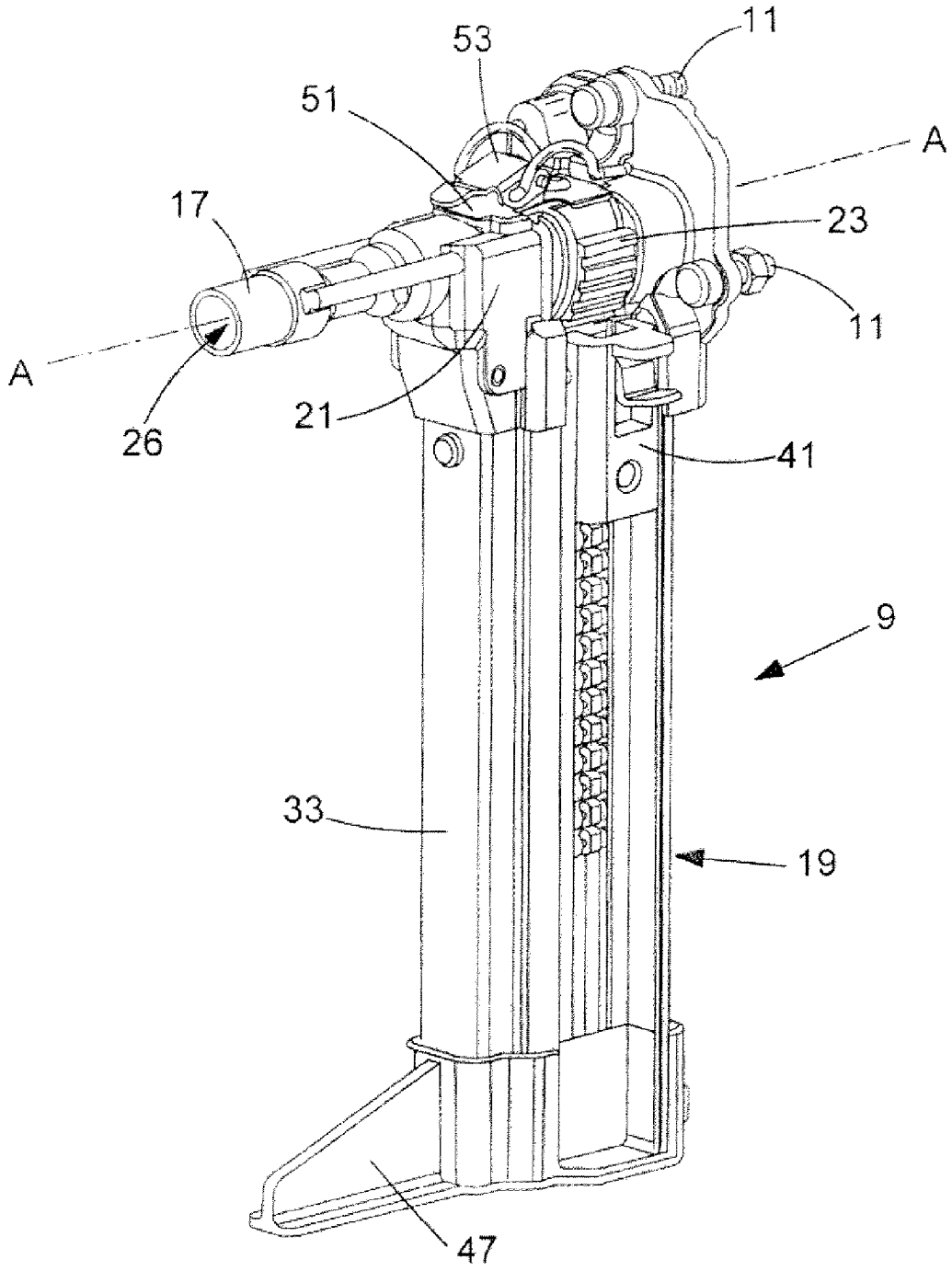
FIGS. 18 to 22 are views of a second embodiment of a fastener supply assembly according to the invention, and components thereof.

FIG. 18 shows a view similar to that shown in FIG. 4, but of a second embodiment of a fastener supply assembly 9 according to the invention, and components thereof. Components of this fastener supply assembly are shown in FIGS. 19 to 22. Like parts are given the same reference numerals. As explained above, the fastener supply assembly 9 is attached to the front of the main body 3 of the fastening driving tool by means of screws 11. The fastener supply assembly 9 comprises a magazine 19, a housing part 21, a nose part 17, and a channel selector 23. A pivotable access cover 51 is secured to the top of the housing part 21 by means of an over-centre latch 53. An outlet passage 26, from which fasteners are fired from the tool, extends through the nose part 17 and channel selector 23, and has a longitudinal axis A-A. Both the nose part 17 and the channel selector 23 are partially housed in the housing part 21. The channel selector 23 is rotationally arranged in the housing part 21, so that it can rotate about the longitudinal axis A-A of the outlet passage.

Figure 19:
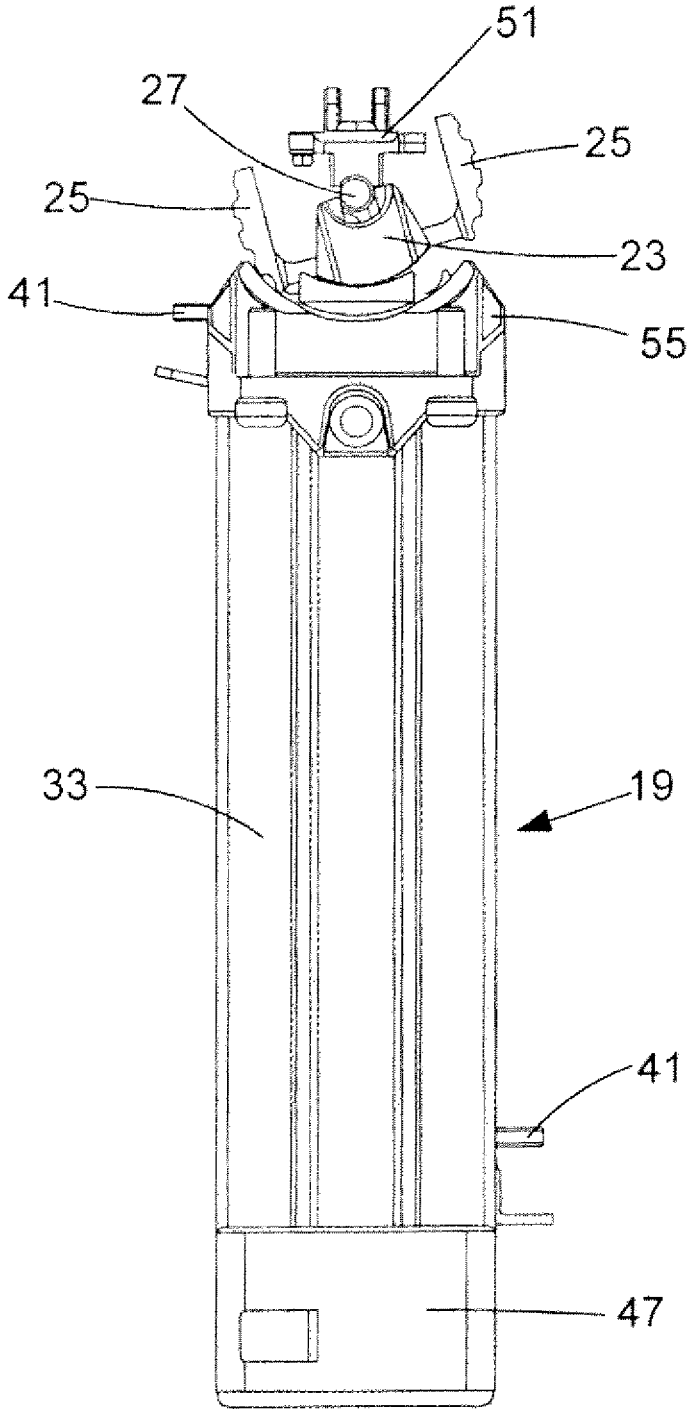
Figure 20:
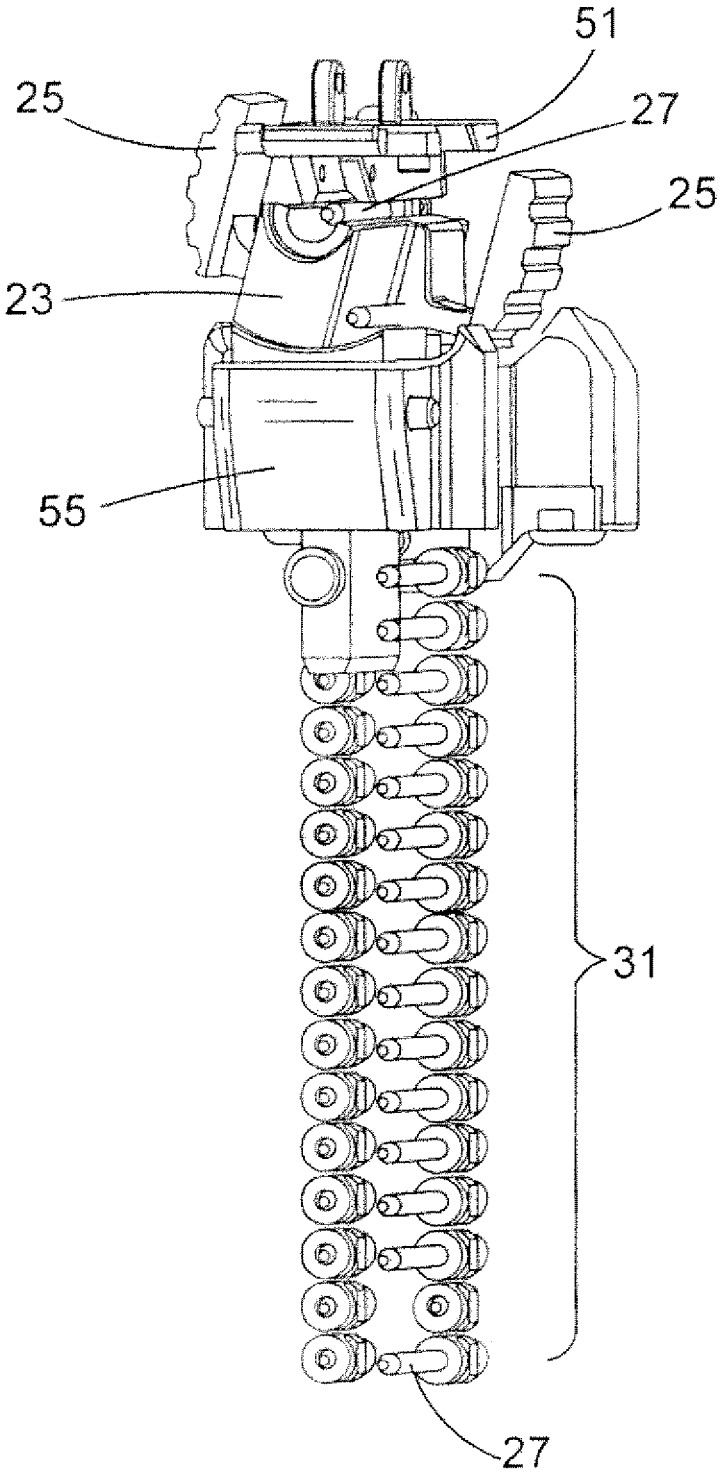
Figure 21:
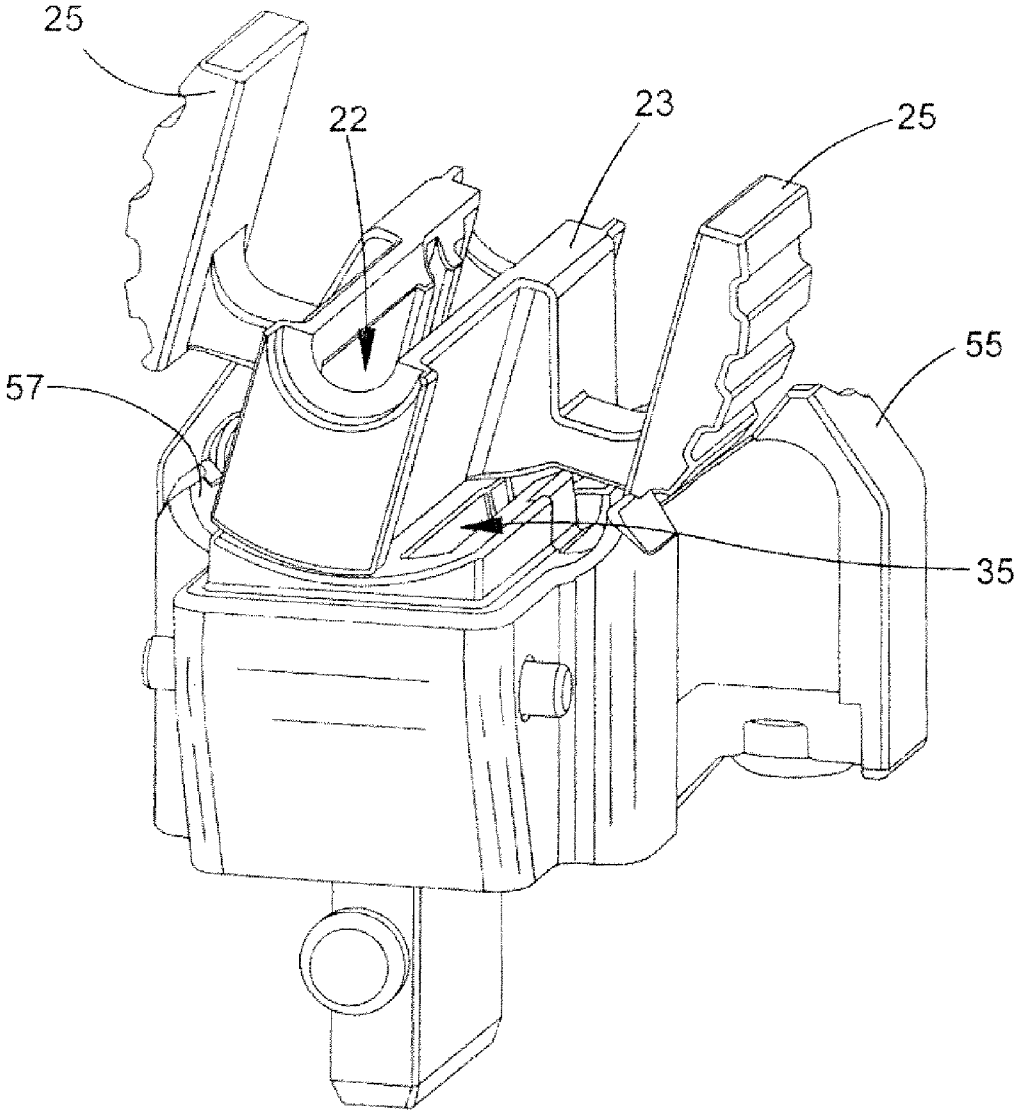
Figure 22:
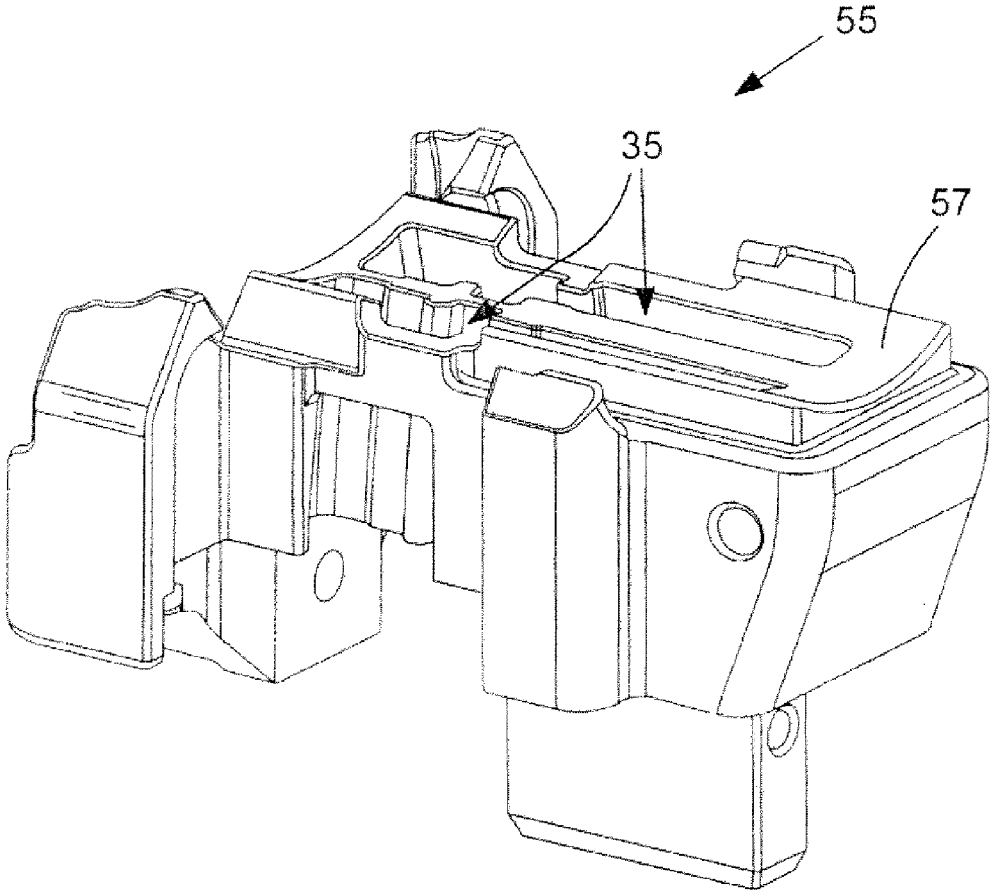

As shown in FIGS. 19 and 20, the channel selector 23 provides part of the circumference of part of the length of the outlet passage 26, and the access cover 51 provides another part of the circumference of that length region of the outlet passage. Thus, the channel selector 23 and the access cover 51 in combination provide part of the length of the outlet passage 26.

Also shown in FIGS. 18 to 22 is a transition part 55 of the magazine 19, which is located between the frame 33 and the housing part 21. In this embodiment of the invention, the transition part 55 provides a region of the supply channels 35 in which they converge toward each other, but do not meet as they approach the channel selector 23. Such convergence of the supply channels 35 reduces the angular amount through which the channel selector 23 must rotate in order to select the respective supply channels, and also helps to provide a smooth, such as curved, deflection in the transition path of a fastener from its supply channel to the channel selector. The transition part 55 also includes a concavely curved surface 57 adjacent to the channel selector 23, on which (or adjacent to which) the channel selector rotates, in use. The channel selector may also include a corresponding convexly curved surface adjacent to the concave surface 57 of the transition part 55.

It will be understood that the above description and the drawings are of particular examples of the invention, but that other examples of the invention are included in the scope of the claims.

We claim:

1. A fastener supply assembly for a fastener driving tool, comprising:

an outlet passage arranged to expel fasteners from the assembly to a workpiece during use;

a magazine comprising a plurality of supply channels arranged to hold fasteners and supply them to the outlet passage; and a channel selector having an opening, wherein the channel selector is arranged to selectively connect, via the opening, the outlet passage with each respective supply channel of the magazine, by rotational movement of the channel selector relative to the magazine and about a longitudinal axis of the outlet passage.

2. The fastener supply assembly according to claim 1, wherein the magazine comprises exactly two supply channels.

3. The fastener supply assembly according to claim 1, wherein the plurality of supply channels are arranged substantially parallel to each other along at least part of their length.

4. The fastener supply assembly according to claim 1, wherein the supply channels converge toward each other along at least part of their length.

5. The fastener supply assembly according to claim 4, wherein the plurality of supply channels converge toward each other as they approach the channel selector.

6. The fastener supply assembly according to claim 1, wherein the magazine comprises a frame defining the plurality of supply channels.

7. The fastener supply assembly according to claim 6, wherein the plurality of supply channels are provided on opposite sides of a wall of the frame.

8. The fastener supply assembly according to claim 7, wherein the magazine comprises an elongate frame, and the wall is a substantially central elongate wall thereof.

9. The fastener supply assembly according to claim 7, wherein each supply channel is at least partially open on a side thereof opposite to the wall.

10. The fastener supply assembly according to claim 1, wherein the magazine includes at least one urging assembly arranged to urge fasteners toward the outlet passage, in use.

11. The fastener supply assembly according to claim 10, wherein each supply channel of the magazine includes a respective urging assembly.

12. The fastener supply assembly according to claim 10, wherein the at least one urging assembly includes a roll spring.

13. The fastener supply assembly according to claim 1, wherein, at least in use, the magazine is located in a fixed position with respect to the outlet passage.

14. The fastener supply assembly according to claim 1, wherein the channel selector comprises a channel selector body.

15. The fastener supply assembly according to claim 1, wherein, in use, fasteners held in the plurality of supply channels of the magazine are arranged to be supplied to the outlet passage by passing through the opening in the channel selector.

16. The fastener supply assembly according to claim 1, wherein the channel selector provides at least part of the outlet passage.

17. The fastener supply assembly according to claim 1, wherein the channel selector comprises the opening, at least part of the outlet passage, and a delivery channel situated between the outlet passage and the opening, by which the opening communicates with the outlet passage.

18. The fastener supply assembly according to claim 1, wherein the channel selector is rotatably arranged in the housing part and includes at least one protrusion projecting outside the housing part, by which the channel selector can be manipulated.

19. The fastener supply assembly according to claim 1, further comprising a nose part providing at least part of the outlet passage, the nose part being located at least partly forward of the channel selector in the direction of expulsion of fasteners from the assembly and resiliently retractable with respect to the channel selector.

* * * * *